US005320230A

United States Patent [19]

Hsiung

[11] Patent Number: 5,320,230

[45] Date of Patent: Jun. 14, 1994

[54] BASE CONFIGURATION FOR BIAXIAL STRETCHED BLOW MOLDED PET CONTAINERS

[75] Inventor: Shieh M. Hsiung, Hsin-Chu, Taiwan

[73] Assignee: Yuan Fang Limited, Taipei, Taiwan

[21] Appl. No.: 894,905

[22] Filed: Jun. 8, 1992

[51] Int. Cl.[5] ..... B65D 1/02; B65D 1/42; B65D 23/00

[52] U.S. Cl. ..... 215/1 C; 220/606; 220/608; 220/609

[58] Field of Search ..... 215/1 C; 220/606, 608

[56] References Cited

U.S. PATENT DOCUMENTS

| | | | |
|---|---|---|---|
| 3,727,783 | 4/1973 | Carmichael | 220/608 X |
| 3,935,955 | 2/1976 | Das | 220/606 X |
| 4,134,510 | 1/1979 | Chang | 220/606 X |
| 4,249,667 | 2/1981 | Pocock et al. | 220/606 X |
| 4,294,366 | 10/1981 | Chang | 220/606 X |
| 4,318,489 | 3/1982 | Snyder et al. | 220/606 X |
| 4,335,821 | 6/1982 | Collette et al. | 220/606 X |
| 4,785,949 | 11/1988 | Krishnakumar et al. | 215/1 C |
| 4,865,206 | 9/1989 | Behm et al. | 220/606 X |
| 5,024,340 | 6/1991 | Alberghini et al. | 220/606 X |
| 5,064,080 | 11/1991 | Young et al. | 220/606 X |

FOREIGN PATENT DOCUMENTS

| | | | |
|---|---|---|---|
| 385693 | 9/1990 | European Pat. Off. | 215/1 C |
| 3275431 | 12/1991 | Japan | 215/1 C |
| 444943 | 2/1992 | Japan | 215/1 C |
| 8605462 | 9/1976 | PCT Int'l Appl. | 220/606 |
| 2067160 | 7/1981 | United Kingdom | 215/1 C |

*Primary Examiner*—Sue A. Weaver

*Attorney, Agent, or Firm*—Morton J. Rosenberg; David I. Klein

[57] ABSTRACT

A base configuration for use with biaxially stretched blow molded PET containers is provided. In particular, the base includes a concave spherical portion disposed at a central position on the base. A protruding annular member is formed around the circumference of the concave spherical portion, and five legs extend radially outward from the annular member. The outer surface of each leg subtends an angle ranging from 40–72 degrees, and a curved rib formed between every pair of legs, the rib subtending an angle ranging from 32–0 degrees, whereby the base of the container has an increased internal pressure resistance and thus prevents cracking in the base.

4 Claims, 4 Drawing Sheets

BASE CONFIGURATION FOR BIAXIAL STRETCHED BLOW MOLDED PET CONTAINERS

BACKGROUND OF THE INVENTION

There are a variety of base configurations for biaxially stretched blow molded PET containers on the market. These include configurations, for example, described in U.S. Pat. Nos. 3,935,955 and 4,785,949. The former (see FIGS. 5 and 6) comprises a central concave dome portion and a plurality of triangular foot portions. However, stress cracks or even rupture is initiated in such base configuration when the applied pressure exceeds a certain critical level. The latter (see FIGS. 7 and 8) comprises a central convex portion and five radiating legs, and is characterized in that the legs and feet are generally of the same outline as the ribs and legs of a base configuration having six legs and feet, thereby rendering the ribs between the feet of greater width. Although this base configuration may increase the cross sectional area of the rib, it is inevitable to use a concave corner to connect the leg with the rib, thus easily resulting in cracking in the concave corner portions.

Therefore, it is an object of the present invention to provide a base configuration for biaxial stretched blow molded PET containers which may obviate and mitigate the above-mentioned drawbacks.

SUMMARY OF THE INVENTION

This invention relates to an improved base configuration for biaxially stretched blow molded PET containers.

It is the primary object of the present invention to provide a base configuration for biaxially stretched blow molded PET containers which has a high internal pressure resistance.

It is another object of the present invention to provide a base configuration for biaxially stretched blow molded PET containers which possesses a high drop impact resistance.

It is still another object of the present invention to provide a base configuration for biaxially stretched blow molded PET containers which has good standing stability.

It is still another object of the present invention to provide a base configuration for biaxially stretched blow molded PET containers which is of high blow moldability and strength to resist cracking.

It is a further object of the present invention to provide a base configuration for biaxially stretched blow molded PET containers which has a larger volume than it would otherwise have.

Other objects and merits and a more full understanding of the present invention will be obtained by those having ordinary skill in the art when the following detailed description is read in conjunction with the accompanying drawings.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practices or carried out in various ways. Also it is to be understood that the phraseology or terminology employed herein is for the purpose of description and not of limitation.

Figure 1:
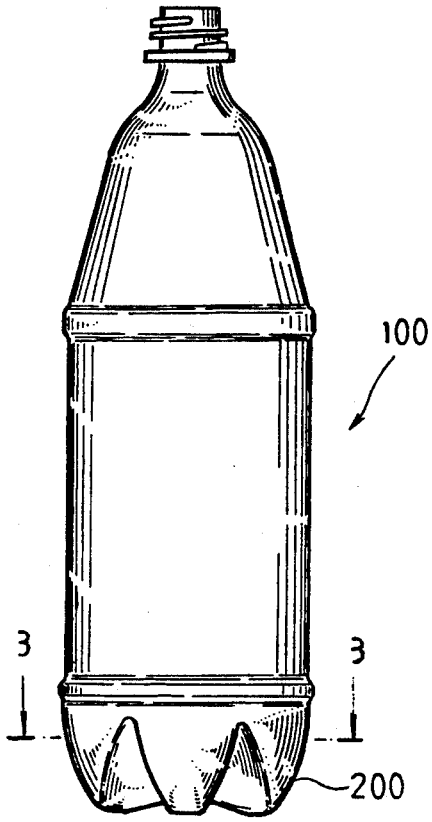
FIG. 1 is a front view of the present invention.

With reference to the drawings and in particular to FIG. 1 thereof, the numeral 100 denotes a plastic container 100 which is characterized in the base configuration 200. The container 100 is made of PET (polyethylene terepthalate), such as PET material, which is biaxially stretched blow molded from a preform.

Figure 2:
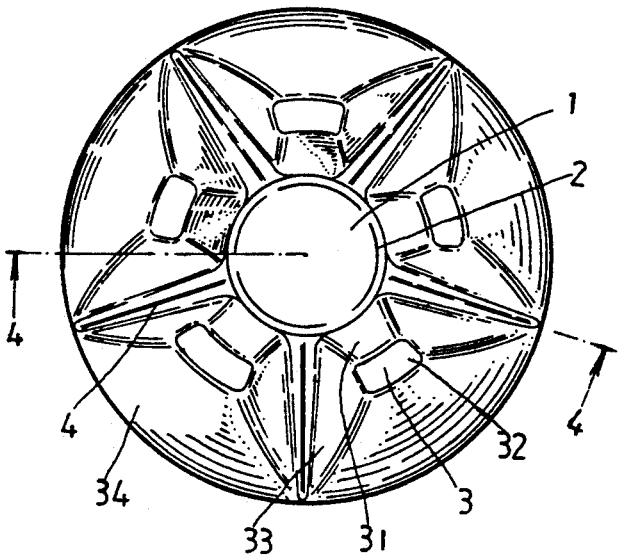
FIG. 2 is a bottom view of the present invention.
Figure 3:
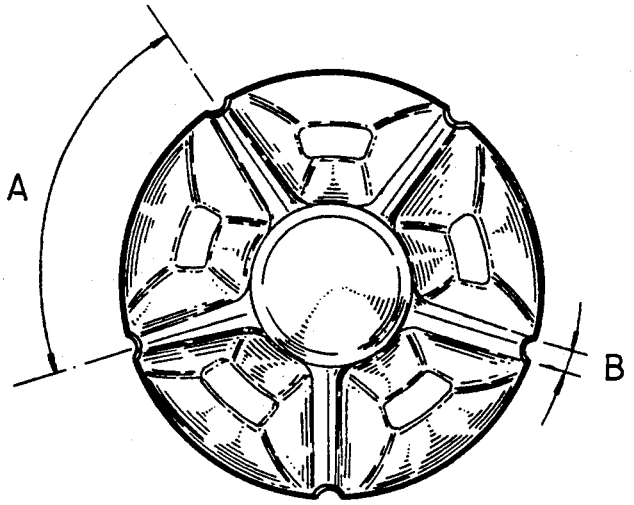
FIG. 3 is a sectional view taken along section line 3—3 of FIG. 1.
Figure 4:
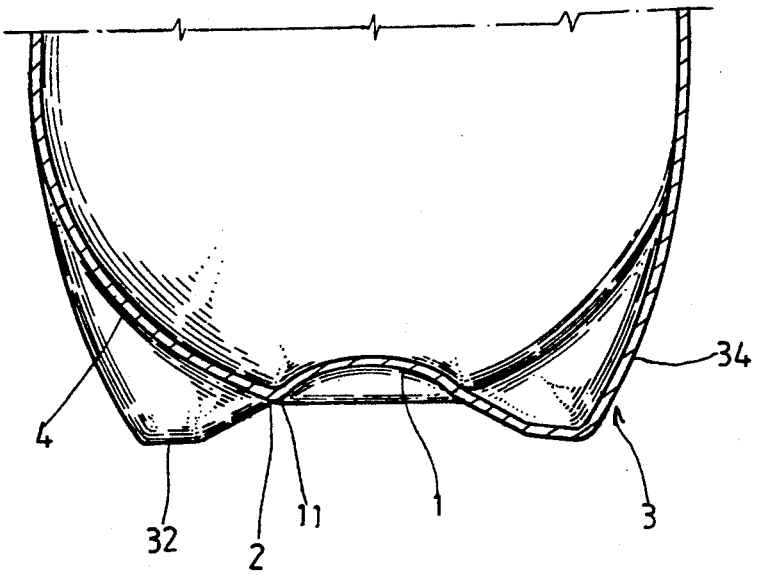
FIG. 4 is a sectional view taken along section line 4—4 of FIG. 2.
Figure 5:
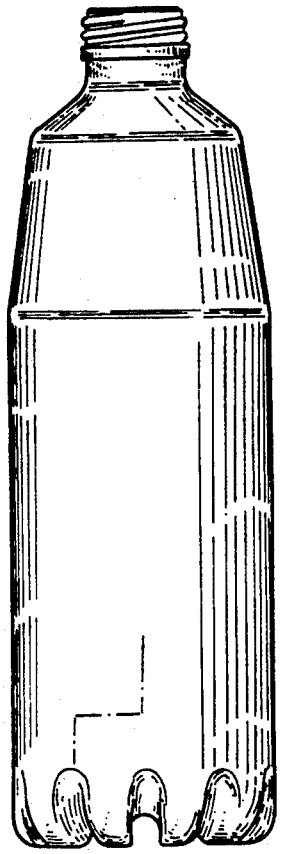
PRIOR ART FIG. 5
FIG. 5 is a front view of a prior art PET container.
Figure 6:
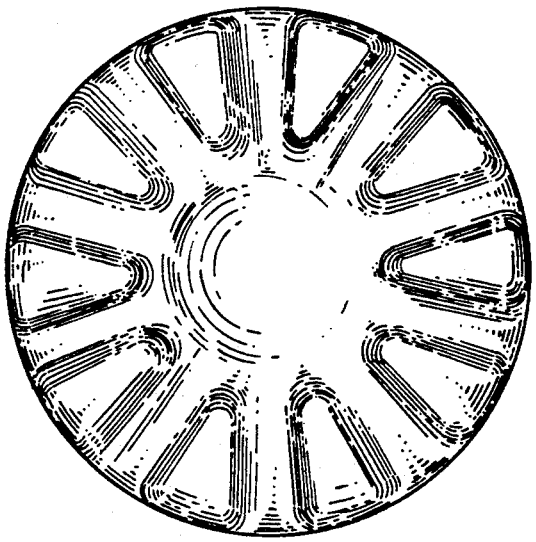
PRIOR ART FIG. 6
FIG. 6 is a bottom view of FIG. 5.
Figure 7:
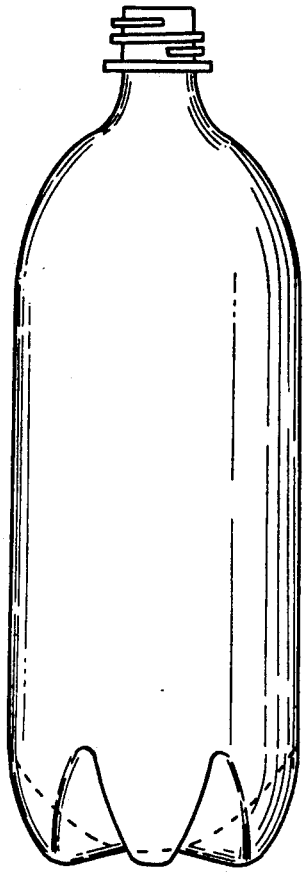
PRIOR ART FIG. 7
FIG. 7 is a front view of another prior art PET container.
Figure 8:
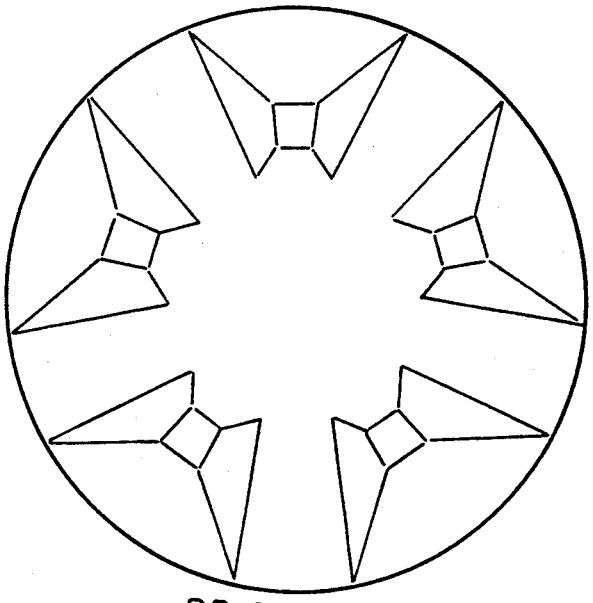
PRIOR ART FIG. 8
FIG. 8 is a bottom view of FIG. 7.

As shown in FIGS. 2, 3 and 4, the base configuration 200 is provided with a generally spherical surface, the center of which there is formed a concave spherical portion 1. The concave spherical portion 1 is designed to provide greater strength and improve the thermal stability, so as to prevent the base 200 from stress cracking and increase the flexibility thereof.

Around the concave spherical portion 1 there is an annular groove 2 forming a protruding circular member 11 on the circumferential edge of the concave spherical portion 1, thereby providing greater strength and preventing the base 200 from stress cracking.

Five legs 3 extend radially outward from the annular groove 2, each of which comprises an inner side 31, a lower side 32, left and right sides 33, and an outer side 34. The inner side 31 is an inclined surface extending radially and outwardly with respect to the annular groove 2. The lower side 32 is a horizontal surface or an inclined surface extending radially and inwardly with respect to the annular groove 2. The left and right sides 33 are inclined surfaces. The outer surface 34 is a curved surface extending downwardly from the body of the container 100. The left side and right side 33 of each leg 3, together, subtend an angle A (shown in FIG. 3) ranging from 40 degrees to 72 degrees. In this preferred embodiment, the two sides 33 subtend an angle of 72 degrees.

Between every two legs 3 there is a curved rib 4 which subtends an angle B ranging from 32 degrees to 0 degree. In this preferred embodiment an angle of 0 degree is subtended by the curved rib 4.

As shown in FIG. 2, the base configuration 200 according to the present invention is characterized in the concave spherical portion 1, the annular groove 2, the rib 4 subtending an angle of 0 degree, and the left and right sides of each leg, together (defining the circumferential arc subtended by the outer surface 34) subtending an angle of 72 degrees. Hence, the present invention can be clearly distinguished from the prior art shown in FIGS. 5–8. Further, in numerous experiments using biaxially stretched blow molding techniques, the base configuration of the present invention possessed higher strength than those prior art configurations.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A base configuration (200) having a substantially circular cross-sectional contour for a biaxially stretched blow molded PET container (100), comprising:

a concave spherical portion (1) disposed centrally in said base configuration;

an outwardly protruding annular member (11) defined by an annular groove (2), said outwardly protruding annular member (11) being disposed on a circumferential edge of said concave spherical portion;

five legs (3) extending radially outward from said annular groove, each of said legs including:

(a) an outer surface (34) having an arcuate surface contour and extending to a lower surface (32), (b) an inner side surface (31) extending radially outward and downward from said annular groove to said lower surface, and (c) a pair of inclined left and right sides (33, 33), each of said sides extending radially from said annular groove to said outer surface and downward to said lower surface; and, (d) five curved ribs (4), each of said five curved ribs being formed between a respective pair of said five legs and extending from said annular groove to an upper section of consecutively displaced legs, each of said five curved ribs being formed in contiguous relation with a respective right side and a respective left side of consecutively displaced legs.

2. The base configuration as recited in claim 1 where said lower surface is inclined upwardly toward said protruding annular member.

3. The base configuration as recited in claim 1 where said outer surface has an angular extent in the approximating range of 40 to 72 degrees with respect to said substantially circular cross-sectional contour.

4. The base configuration as recited in claim 3 where said outer surface has an angular extent approximating 72 degrees with respect to said substantially circular cross-sectional contour.

* * * * *